US010619419B2

(12) United States Patent
Williams et al.

(10) Patent No.: US 10,619,419 B2
(45) Date of Patent: Apr. 14, 2020

(54) DRILL BIT HAVING IMPROVED JOURNAL BEARINGS

(71) Applicant: HALLIBURTON ENERGY SERVICES, INC., Houston, TX (US)

(72) Inventors: Mark Evans Williams, Conroe, TX (US); Micheal Burl Crawford, Montgomery, TX (US); Jay Stuart Bird, The Woodlands, TX (US); Young Ho Lee, Conroe, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 337 days.

(21) Appl. No.: 15/038,411

(22) PCT Filed: Dec. 13, 2013

(86) PCT No.: PCT/US2013/074931
§ 371 (c)(1),
(2) Date: May 20, 2016

(87) PCT Pub. No.: WO2015/088550
PCT Pub. Date: Jun. 18, 2015

(65) Prior Publication Data

US 2016/0290052 A1 Oct. 6, 2016

(51) Int. Cl.
*E21B 10/22* (2006.01)
*E21B 10/23* (2006.01)
(Continued)

(52) U.S. Cl.
CPC ..... *E21B 10/22* (2013.01); *E21B 10/18* (2013.01); *E21B 10/24* (2013.01); *E21B 10/50* (2013.01)

(58) Field of Classification Search
CPC .... E21B 10/23; E21B 10/24; E21B 2010/225; E21B 2010/243; E21B 2010/246
See application file for complete search history.

(56) References Cited

U.S. PATENT DOCUMENTS 3,784,264 A * 1/1974 Jackson, Jr. ..... C10M 5/00 175/227
4,204,437 A 5/1980 Espana
(Continued)

FOREIGN PATENT DOCUMENTS

CN 2809186 Y 8/2006
CN 101812970 A 8/2010

OTHER PUBLICATIONS

International Search Report and Written Opinion, dated Sep. 17, 2014, 12 pages, Korean Intellectual Property Office.
(Continued)

*Primary Examiner* — Robert E Fuller
*Assistant Examiner* — Lamia Quaim

(57) ABSTRACT

A disclosed example embodiment includes a drill bit used to form wellbores in subterranean formations. The drill bit includes a drill bit body for coupling to a lower end of a drill string. The drill bit body includes at least one support arm having an inwardly extending journal with a journal bearing having at least one radially reduced pocket extending at least partially circumferentially around the journal bearing including a load side of the journal bearing. At least one rotary cutter assembly is rotatably mounted to the journal. A plurality of cutting elements is disposed on the at least one rotary cutter assembly. At least two independent hardmetal pads are positioned within the at least one radially reduced pocket such that the hardmetal pads have a gap disposed therebetween.

13 Claims, 7 Drawing Sheets

(51) Int. Cl.

| | |
|---|---|
| ***E21B 10/24*** | (2006.01) |
| ***E21B 10/18*** | (2006.01) |
| ***E21B 10/50*** | (2006.01) |

(56) References Cited

U.S. PATENT DOCUMENTS

| | | | | |
|---|---|---|---|---|
| 4,260,203 | A * | 4/1981 | Garner | E21B 10/22 384/96 |
| 4,323,284 | A | 4/1982 | Childers et al. | |
| 4,738,322 | A | 4/1988 | Hall et al. | |
| 4,753,304 | A | 6/1988 | Kelly, Jr. | |
| 4,874,047 | A * | 10/1989 | Hixon | E21B 10/20 175/369 |
| 6,056,072 | A | 5/2000 | Koltermann et al. | |
| 7,552,783 | B2 | 6/2009 | Viswanadham | |
| 2005/0133265 | A1 | 6/2005 | Denton et al. | |
| 2009/0236147 | A1 | 9/2009 | Koltermann et al. | |

OTHER PUBLICATIONS

The State of Intellectual Property Office of the People's Republic of China, First Office Action, dated Mar. 15, 2017, 8 pages, China.

* cited by examiner

DRILL BIT HAVING IMPROVED JOURNAL BEARINGS

The present application is a U.S. National Stage patent application of International Patent Application No. PCT/US13/74931, filed on Dec. 13, 2013, the benefit of which is claimed and the disclosure of which is incorporated herein by reference in its entirety.

TECHNICAL FIELD OF THE DISCLOSURE

This disclosure relates, in general, to equipment utilized in conjunction with operations performed in relation to subterranean wells and, in particular, to a drill bit having improved journal bearings including independent hardmetal weld pads.

BACKGROUND

Wells are commonly drilled to recover hydrocarbons, such as oil and gas, from subterranean formations. Drilling a well typically entails rotating a drill bit positioned at the end of a drill string comprising a plurality of drill pipe segments connected end to end. As the wellbore is drilled, additional segments of drill pipe are added from the surface to reach the desired drilling depth. A wide variety of drill bits are known in the art, each having different attributes that can be considered in selecting a bit for a particular application.

One general type of drill bit is a rotary cone or roller cone drill bit. A rotary cone drill bit generally includes at least one support arm, and most often three support arms. Each support arm has a respective rotary cutter assembly rotatably mounted on a journal. Each rotary cutter assembly typically includes a cavity with a configuration and interior dimensions sized to receive exterior portions of the associated journal therein. Any of a wide variety of bearings, bearing assemblies or other supporting structures may be disposed between interior portions of each rotary cutter assembly and exterior portions of the associated journal, including journal bearings. Surface coatings, such as silver, may be engineered onto bearing surfaces to protect the surfaces. In addition, grease may be used to fill the cavities within the rotary cutter assemblies to provide the lubrication required between the moving parts. Fluid barriers, such as seals and diaphragms may be used to prevent drilling mud from entering into the rotary cutter assemblies. Such fluid barriers may be formed from an elastomer such as hydrogenated nitrile rubber (HNBR).

During drilling with a rotary cone bit, the cutting surfaces of the rotary cutter assemblies are pushed against the bottom of the borehole while rotating the drill bit, which causes the rotary cutter assemblies to rotate about their respective journals. Components within the drill bit, such as the journal bearing, are subjected to severe operating conditions including high unit loading, repetitive shock loading and high contract pressures, which can lead to galling or other degradation of the bearing surfaces.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
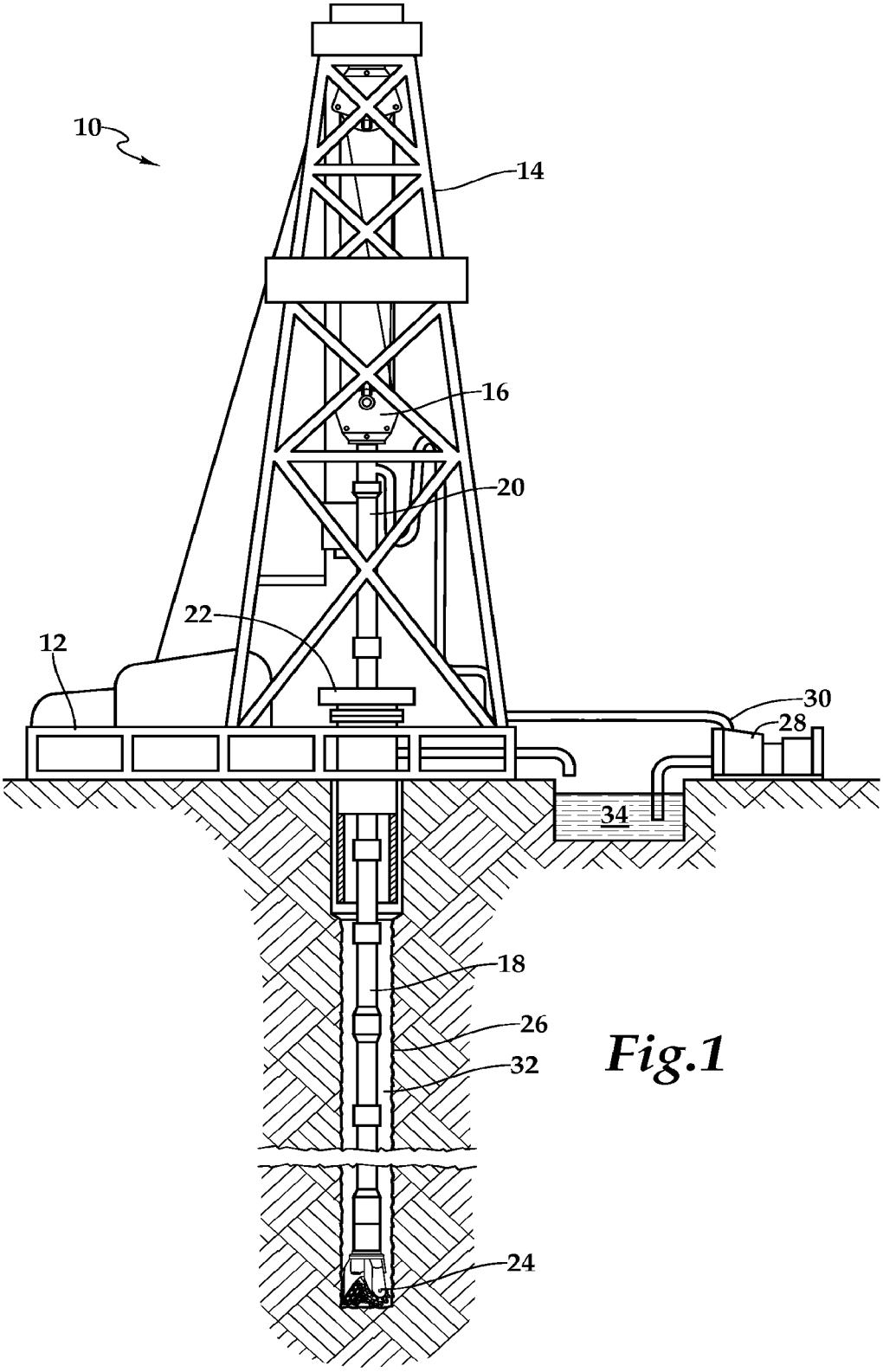
FIG. 1 is a schematic illustration of a well system during a drilling operation using a drill bit having improved journal bearings including independent hardmetal weld pads according to an embodiment of the present disclosure.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

In a first aspect, the present disclosure is directed to a drill bit including a drill bit body for coupling to a lower end of a drill string. The drill bit body includes at least one support arm having an inwardly extending journal with a journal bearing having at least one radially reduced pocket extending at least partially circumferentially around the journal bearing including a load side of the journal bearing. At least one rotary cutter assembly is rotatably mounted to the journal. A plurality of cutting elements is disposed on the at least one rotary cutter assembly. At least two independent hardmetal pads are positioned within the at least one radially reduced pocket such that the hardmetal pads have a gap disposed therebetween.

In certain embodiments, the hardmetal pads may be hardmetal weld pads. In one embodiment, the gap may be a base metal section of the journal bearing. In this embodiment, an interior surface of the rotary cutter assembly may include a circumferentially extending groove positioned adjacent to the base metal gap to prevent contact between the base metal gap and the interior surface of the rotary cutter assembly. In another embodiment, the gap may be a radially reduced groove disposed between the hardmetal pads. The radially reduced groove may be a circumferentially extending radially reduced groove that extends the circumferential length of the radially reduced pocket or circumferentially beyond the radially reduced pocket. In some embodiments, the radially reduced groove may be in fluid communication with a grease reservoir of the journal bearing. In certain embodiments, the at least one radially reduced pocket and the hardmetal pads may extend circumferentially 360 degrees around the journal bearing. In particular embodiments, at least three hardmetal pads may be independently positioned within the at least one radially reduced pocket.

In a second aspect, the present disclosure is directed to a drill bit including a drill bit body for coupling to a lower end of a drill string. The drill bit body includes at least one support arm having an inwardly extending journal with a journal bearing having a grease reservoir and at least one radially reduced pocket extending at least partially circumferentially around the journal bearing including a load side of the journal bearing. At least one rotary cutter assembly is rotatably mounted to the journal. A plurality of cutting elements is disposed on the at least one rotary cutter assembly. At least two independent hardmetal weld pads are positioned within the at least one radially reduced pocket. The hardmetal weld pads have a circumferentially extending radially reduced groove disposed therebetween that is in fluid communication with the grease reservoir.

In a third aspect, the present disclosure is directed to method of producing a journal bearing for a drill bit. The method includes forming at least one radially reduced pocket extending at least partially circumferentially around the journal bearing including a load side of the journal bearing and positioning at least two independent hardmetal pads within the at least one radially reduced pocket by having a gap disposed between the hardmetal pads.

The method may also include applying a first hardmetal pad within the at least one radially reduced pocket and applying a second hardmetal pad within the at least one radially reduced pocket while maintaining a base metal section of the journal bearing between the first and second hardmetal pads; forming a radially reduced groove between the at least two hardmetal pads; forming a circumferentially extending radially reduced groove between the at least two hardmetal pads; extending the circumferentially extending radially reduced groove circumferentially beyond the radially reduced pocket and/or forming a fluid communication path between the radially reduced groove and a grease reservoir of the journal bearing.

Referring initially to FIG. 1, a well system 10 is schematically illustrated during a drilling operation. A drilling platform 12 is equipped with a derrick 14 and a hoist 16 that supports a plurality of drill pipes connected together to form a drill string 18. Hoist 16 suspends a top drive 20 that is used to rotate drill string 18 and to lower drill string 18 through a wellhead 22. A drill bit 24 is securably coupled to the lower end of drill string 18. In the illustrated embodiment, drill bit 24 includes three support arms (only two being visible) each having a rotary cutter assembly rotatably mounted on a journal extending inwardly from an interior surface of each support arm. Each journal includes a journal bearings having at least two independent hardmetal weld pads. In operation, drilling is accomplished by rotating drill bit 24 with drill string 18 to form wellbore 26. Drilling fluid is pumped by mud recirculation equipment 28 through supply pipe 30 to top drive 20 and down through drill string 18. The drilling fluid exits drill string 18 through nozzles in drill bit 24, cooling drill bit 24 and then carry drilling cuttings to the surface via an annulus 32 between the exterior of drill string 18 and wellbore 26. The drilling fluid then returns to a mud pit 34 for recirculation.

Even though FIG. 1 depicts the present system in a vertical wellbore, it should be understood by those skilled in the art that the present system is equally well suited for use in wellbores having other orientations including horizontal wellbores, deviated wellbores, slanted wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an onshore operation, it should be understood by those skilled in the art that the present system is equally well suited for use in offshore operations.

Figure 2:
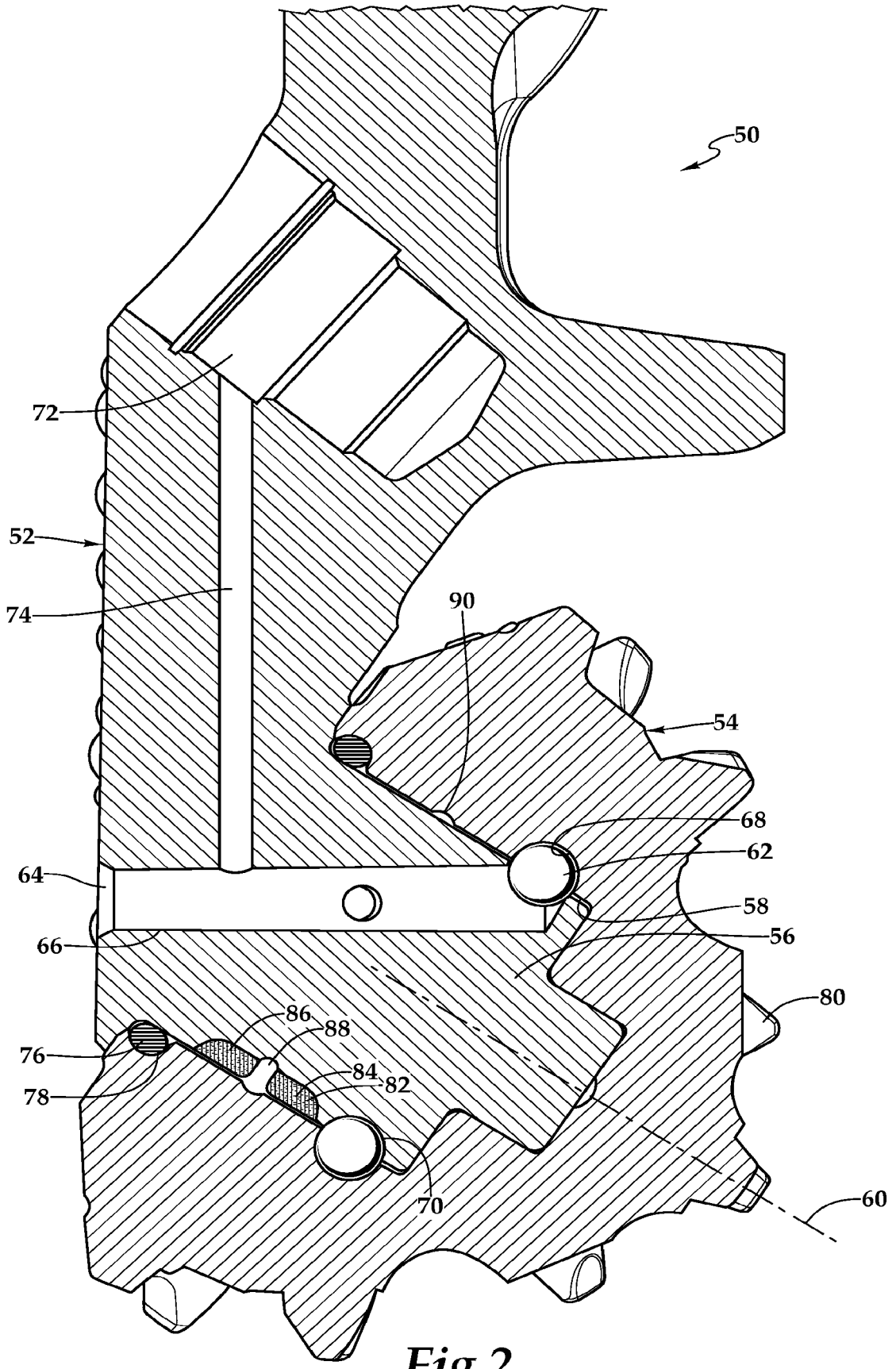
FIG. 2 is a cross sectional view of a portion of a drill bit having an improved journal bearing including independent hardmetal weld pads according to an embodiment of the present disclosure.

FIG. 2 is a cross sectional view of a portion of a rotary cone drill bit 50. Drill bit 50 has support arms 52 and rotary cutter assemblies 54, only one of each being visible in FIG. 2. In the illustrated embodiment, each rotary cutter assembly 54 of drill bit 50 is mounted on a journal 56 inwardly projecting from a respective support arm 52. In addition, a bearing system is used to rotatably mount rotary cutter assemblies 54 on respective support arms 52. More specifically, each rotary cutter assembly 54 includes a generally cylindrical cavity 58, which has been sized to receive journal 56 therein. Each rotary cutter assembly 54 and its respective journal 56 has a common axis 60, which also represents the axis of rotation for rotary cutter assembly 54 relative to journal 56. Each rotary cutter assembly 54 is retained on its respective journal 56 by a plurality of ball bearings 62. Ball bearings 62 are inserted through opening 64 and ball retainer passageway 66. Ball races 68, 70 are formed respectively in the interior of cavity 58 of rotary cutter assembly 54 and the exterior of journal 52.

Ball retainer passageway 66 is connected with ball races 68, 70, such that ball bearings 62 may be inserted therethrough to form an annular array within ball races 68, 70 to prevent disengagement of rotary cutter assembly 54 from journal 52. Ball retainer passageway 66 is subsequently plugged by inserting a ball plug retainer (not pictured) therein. A ball plug weld (not pictured) may be formed within each opening 64 to provide a fluid barrier between ball retainer passageway 66 and the exterior of each support arm 52 to prevent contamination and loss of lubricant from the associated sealed lubrication system.

Each support arm 52 preferably includes a lubricant cavity or lubricant reservoir 72 having a generally cylindrical configuration. A lubricant cap (not pictured) is disposed within one end of lubricant cavity 72 to prevent undesired fluid communication between lubricant cavity 72 and the exterior of support arm 52. The lubricant cap may include a flexible, resilient diaphragm (not pictured) that defines the upper portion of lubricant cavity 72 and is operable to expand to provide pressure compensation to the sealed lubrication system. A lubricant passage 74 extends through support arm 52 such that lubricant cavity 72 is in fluid communication with ball retainer passageway 66. Ball retainer passageway 66 provides fluid communication with internal cavity 58 of rotary cutter assembly 54 and the bearing system disposed between the exterior of journal 56 and the interior of cavity 58. Upon assembly of drill bit 50, lubricant passage 74, lubricant cavity 72, any available space in ball retainer passageway 66 and any available space between the interior surface of cavity 58 and the exterior of journal 56 are filled with lubricant through an opening (not pictured) in each support arm 52. The opening is subsequently sealed after lubricant filling.

The pressure of the external fluids outside drill bit 50 may be transmitted to the lubricant contained in lubricant cavity 72 by the diaphragm. The flexing of the diaphragm maintains the lubricant at a pressure generally equal to the pressure of external fluids outside drill bit 50. This pressure is transmitted through lubricant passage 74, ball retainer passageway 66 and internal cavity 58 to expose the inward face of seal element 76 to pressure generally equal to the pressure of the external fluids. More specifically, seal element 76 is positioned within a seal retaining groove 78 within cavity 58 to establish a fluid barrier between cavity 58 and journal 56. Seal element 76 may be an o-ring seal, a d-seal, a t-seal, a v-seal, a flat seal, a lip seal or the like and equivalents thereof that are suitable for establishing the required fluid barrier between cavity 58 and journal 56. As illustrated, rotary cutter assembly 54 includes a plurality of cutting elements 80.

During drilling operations, drill bit 50 and component parts thereof are subjected to severe operating conditions including high unit loading, repetitive shock loading and high contract pressures, which can lead to galling or other degradation of contact surfaces. To prevent such galling of journal 56, particularly on the load side of journal bearing 82, two independent hardmetal weld pads 84, 86 circumferentially extending around a portion of journal bearing 82 including the load side of journal bearing 82. Hardmetal weld pads 84, 86 have a gap disposed therebetween depicted as a radially reduced groove 88. In addition, rotary cutter assembly 54 includes a circumferentially extending groove 90 within cavity 58 that is positioned adjacent to gap 88 and is operable to establish a non-contact surface in certain embodiments of the drill bit of the present disclosure.

Figure 3A:
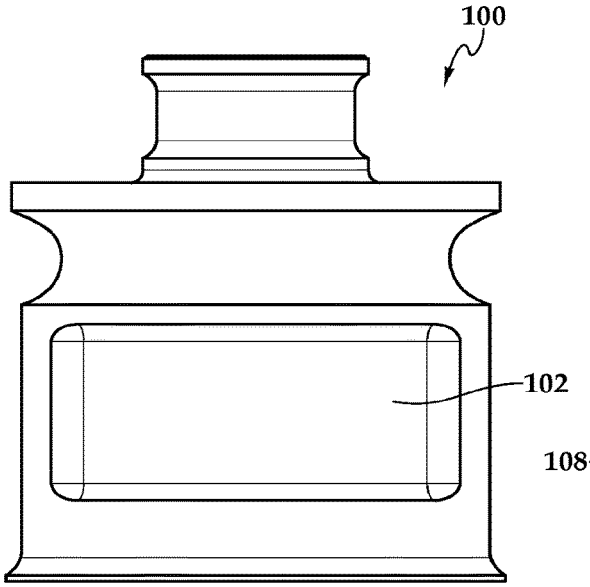
FIGS. 3A-3C are various views of a journal bearing prior to adding independent hardmetal weld pads thereto according to an embodiment of the present disclosure.
Figure 3B:
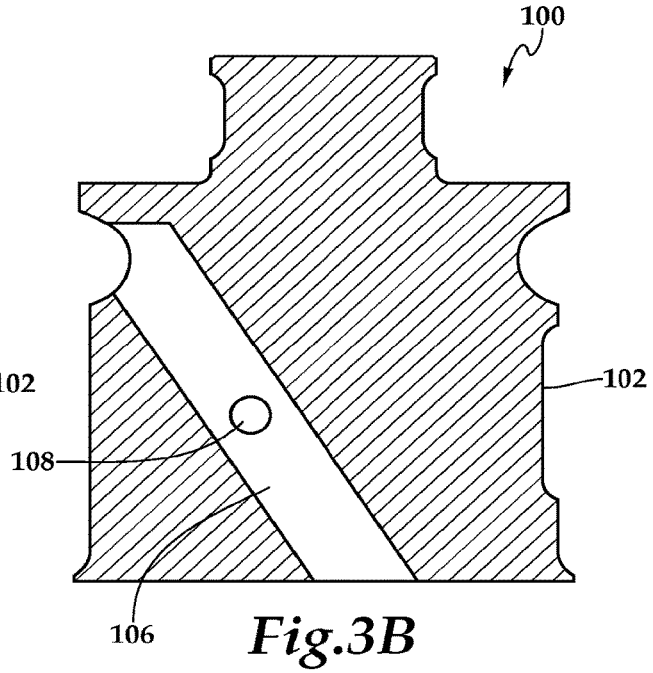
Figure 3C:
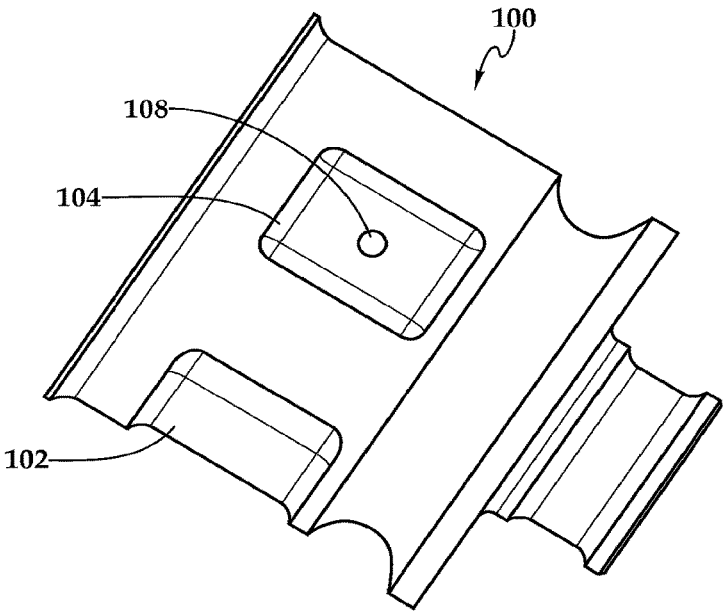

FIGS. 3A-3C are various views of a journal bearing 100 for use in a drill bit of the present disclosure prior to the adding independent hardmetal weld pads thereto. Journal bearing 100 includes a radially reduced pocket 102 positioned on the load side of journal bearing 100, as best seen in FIG. 3C. In the illustrated embodiment, radially reduced pocket 102 extends circumferentially about the load side of journal bearing 100 for approximately 120 degrees. Also, as illustrated, radially reduced pocket 102 has radiused surfaces. Positioned above radially reduced pocket 102 on an unloaded portion of journal bearing 100 arc one or more lubricant reservoirs 104, only one being visible in FIG. 3C. Lubricant reservoir 104 is in fluid communication with ball retainer passageway 106 via a lubricant passage 108, only the ends of which are visible in FIGS. 3B and 3C.

Figure 4A:
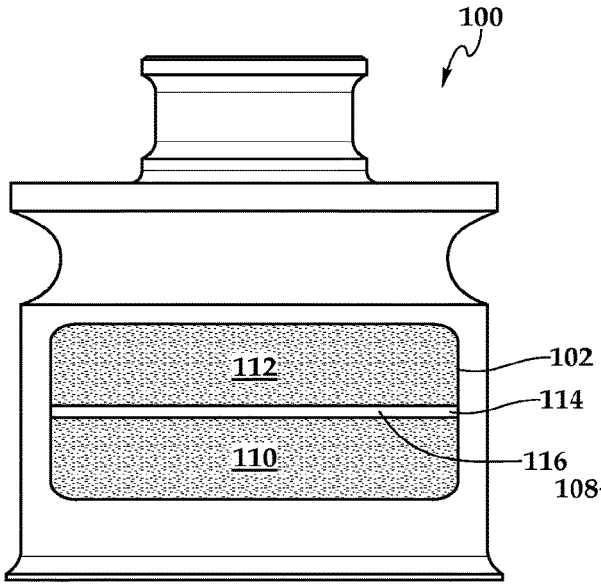
FIGS. 4A-4C are various views of a journal bearing including independent hardmetal weld pads according to an embodiment of the present disclosure.
Figure 4B:
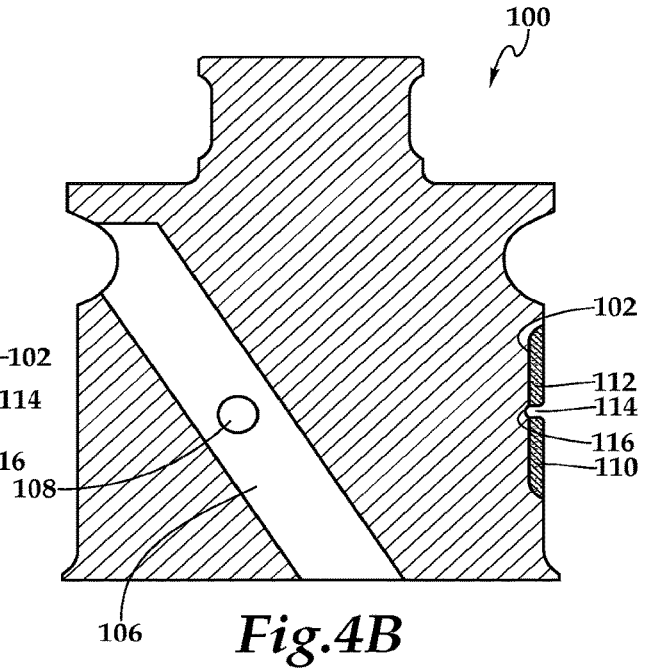
Figure 4C:
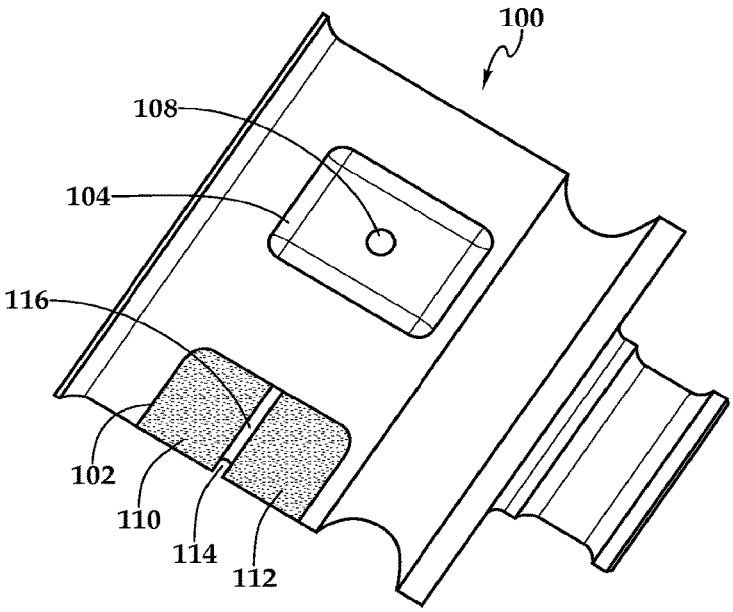

Referring additionally to FIGS. 4A-4C, two independent hardmetal weld pads 110, 112 having a gap 114 disposed therebetween have been positioned in radially reduced pocket 102 of journal bearing 100. The base material of journal bearing 100 may be a steel such as a low alloy carbon steel including 4715 steel. Likewise, the base material of that associated rotary cutter assembly (see FIG. 2) may be a steel such as a low alloy carbon steel including 4715 steel having a silver surface coating on the interior of its cavity. During drilling operations, due to high unit loading, repetitive shock loading and high contract pressures, galling or other degradation of the contact surfaces of journal bearing 100 and the rotary cutter assembly may occur. To prevent this galling, two independent hardmetal weld pads 110, 112 having a gap 114 disposed therebetween have been positioned in radially reduced pocket 102 of journal bearing 100. Hardmetal weld pads 110, 112 may be formed from a steel alloy designed for wear resistance such as cobalt alloys, chromium alloys, nickel alloys or combinations thereof as well as such steel alloys including other alloy elements such as iron, aluminum, boron, carbon, manganese, molybdenum, phosphorus, sulfur, silicon, titanium or combinations thereof including a class of steel alloys referred to as stellite alloys such as stellite 190. Hardmetal pads 110, 112 may be applied into radially reduced pocket 102 using a hardfacing metalworking process wherein the hardmetal pads 110, 112 are applied to the base metal of journal bearing 100 using an arc welding process including, for example, a gas metal arc welding (GMAW) process such as a gas tungsten arc welding (GTAW) process or a tungsten inert gas (TIG) welding process.

Hardmetal pads 110, 112 may be applied into radially reduced pocket 102 independent of one another by, for example, first applying hardmetal pad 110 into radially reduced pocket 102 and second applying hardmetal pad 112 into radially reduced pocket 102. In this process, gap 114 may be formed naturally between hardmetal pads 110, 112 by controlling the welding process. This method has the advantage of reducing the effects of heat on the base metal of journal bearing 100 as well as on previously applied hardmetal as the length of each weld section is relatively short, if the welds are applied in the axial direction of journal bearing 100. After hardmetal pads 110, 112 have been applied into radially reduced pocket 102, the edges of hardmetal pads 110, 112 adjacent to gap 114 may be machined, for example, using a milling process, to clean up gap 114 and form radiused corners on hardmetal pads 110, 112. This clean up process may also include forming a radially reduced groove 116 that extends into the base metal of journal bearing 100.

Alternatively, hardmetal pads 110, 112 may be applied together into radially reduced pocket 102, wherein a single weld process is used to apply the hardmetal that forms hardmetal pad 110 and hardmetal pad 112. In this process, gap 114 is later formed using, for example, a milling process, that may also be used to form radially reduced groove 116 into the base metal of journal bearing 100. After gap 114 has been milled, hardmetal weld pad 110 and hardmetal weld pad 112 are independent of one another. Regardless of the manufacturing technique selected, having independent hardmetal weld pads 110, 112 with gap 114 disposed therebetween has the advantage of preventing heat related cracking or other degradation during subsequent heat treatment processes and use in drilling operations. Once hardmetal pads 110, 112 have been applied into radially reduced pocket 102, the outer surface of journal bearing 100 including hardmetal weld pads 110, 112 may be machined using, for example, a turning process to form a smooth outer surface.

Figure 5A:
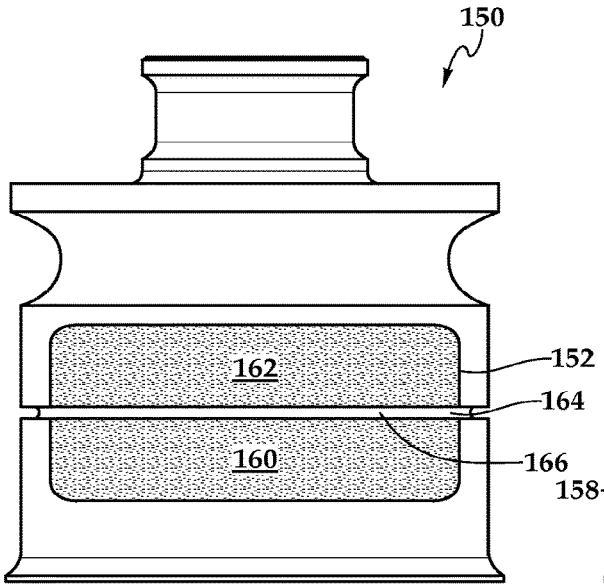
FIGS. 5A-5C are various views of a journal bearing including independent hardmetal weld pads according to an embodiment of the present disclosure.
Figure 5B:
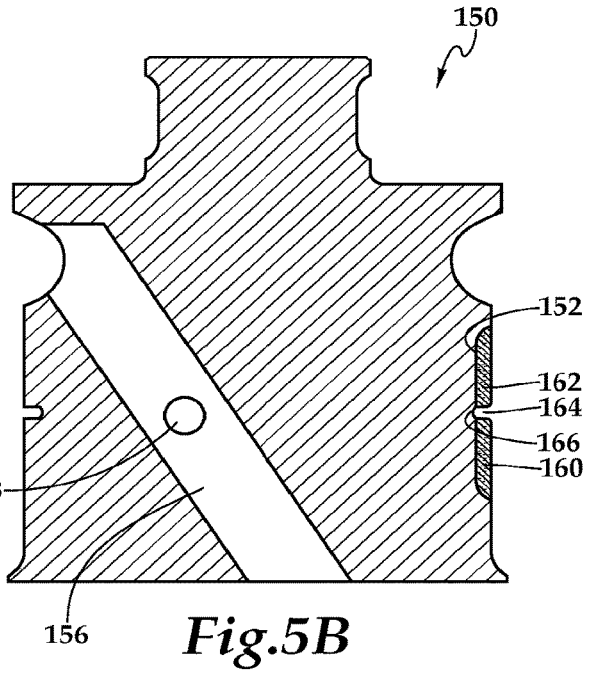
Figure 5C:
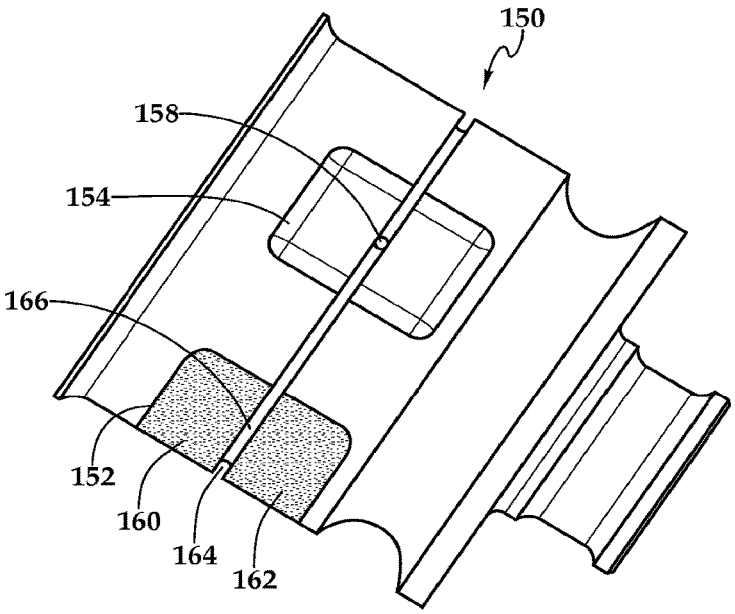

FIGS. 5A-5C are various views of a journal bearing 150. Journal bearing 150 includes a radially reduced pocket 152 positioned on the load side of journal bearing 150, as best seen in FIG. 5C. In the illustrated embodiment, radially reduced pocket 152 extends circumferentially about the load side of journal bearing 150 for approximately 120 degrees. Positioned above radially reduced pocket 152 on an unloaded portion of journal bearing 150 are one or more lubricant reservoirs 154, only one being visible in FIG. 5C.

Lubricant reservoir 154 is in fluid communication with ball retainer passageway 156 via a lubricant passage 158, only the ends of which are visible in FIGS. 5B and 5C. Two independent hardmetal weld pads 160, 162 having a gap 164 disposed therebetween have been positioned in radially reduced pocket 152 of journal bearing 150. Hardmetal weld pads 160, 162 may be applied to radially reduced pocket 152 in a manner described above or other suitable manner. In the illustrated embodiment, once hardmetal weld pads 160, 162 have been applied to radially reduced pocket 152, a radially reduced groove 166 may be machined into journal bearing 150 that extends circumferentially beyond radially reduced pocket 152 and in this case, 360 degrees around journal bearing 150. As illustrated, radially reduced groove 166 intersects lubricant reservoir 154, thereby becoming a lubricant passage to aid in distribution of lubricant to the contact surfaces of hardmetal weld pads 160, 162.

Figure 6:
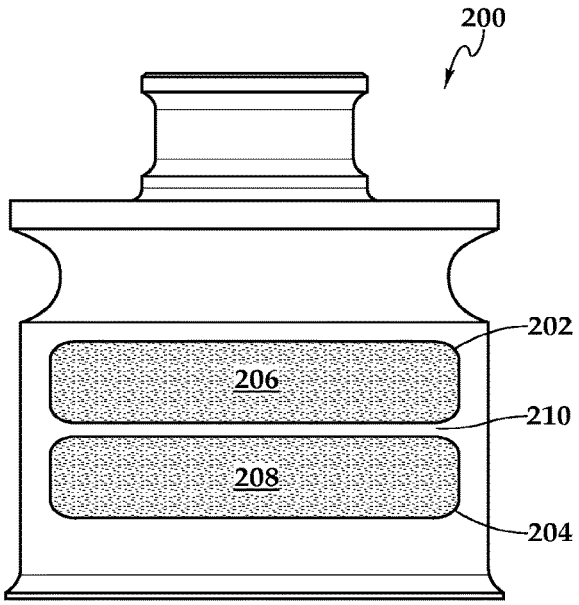
FIG. 6 is side view of a journal bearing including independent hardmetal weld pads according to an embodiment of the present disclosure.

Even though FIGS. 3-5 have depicted and described journal bearings having a single radially reduced pocket, it should be understood by those skilled in the art that journal bearings having other numbers of pockets greater than one are possible and are considered to be within the scope of the present disclosure. For example, as best seen in FIG. 6, a journal bearing 200 includes two radially reduced pockets 202, 204 positioned on the load side of journal bearing 200. In the illustrated embodiment, radially reduced pockets 202, 204 each extends circumferentially about the load side of journal bearing 200 for approximately 120 degrees. A hardmetal weld pads 206 is positioned in radially reduced pocket 202 of journal bearing 200 and a hardmetal weld pads 208 is positioned in radially reduced pocket 204 of journal bearing 200. Hardmetal weld pads 206, 208 may be applied to radially reduced pockets 202, 204 in a manner described above or other suitable manner. In the illustrated embodiment, hardmetal weld pads 206, 208 have a gap 210 disposed therebetween that is formed of the base material of journal bearing 200. In this manner, the two independent radially reduced pockets 202, 204 are used to form the two independent hardmetal weld pads 206, 208. In this embodiment, the base material of journal bearing 200 forming gap 210 may shares the same outer diameter as hardmetal weld pads 206, 208. To assure that the base material of journal bearing 200 forming gap 210 is a non contact surface, journal bearing 200 should be used with a rotary cutter assembly having a circumferentially extending groove adjacent to gap 210 such as that described above with reference to rotary cutter assembly 54 and circumferentially extending groove 90 in FIG. 2. Alternatively or additionally, the base material of journal bearing 200 forming gap 210 could be machined to create a radial reduction sufficient to establish non contact with the associated rotary cutter assembly such as a radial reduction between about 0.005 inches and about 0.050 inches.

Figure 7:
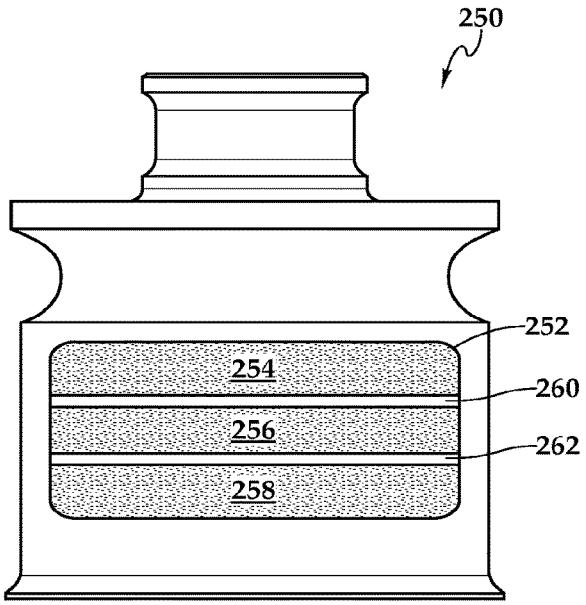
FIG. 7 is side view of a journal bearing including independent hardmetal weld pads according to an embodiment of the present disclosure.

Even though FIGS. 3-6 have depicted and described journal bearings having two independent hardmetal weld pads, it should be understood by those skilled in the art that journal bearings having other numbers of independent hardmetal weld pads greater than two are possible and are considered to be within the scope of the present disclosure. For example, as best seen in FIG. 7, a journal bearing 250 includes a radially reduced pocket 252 positioned on the load side of journal bearing 250. In the illustrated embodiment, radially reduced pocket 252 extends circumferentially about the load side of journal bearing 200 for approximately 120 degrees. Three independent hardmetal weld pads 254, 256, 258 are positioned in radially reduced pocket 252 of journal bearing 250. Hardmetal weld pads 254, 256, 258 may be applied to radially reduced pocket 252 in a manner described above or other suitable manner. In the illustrated embodiment, hardmetal weld pads 254, 256 have a gap 260 disposed therebetween and hardmetal weld pads 256, 258 have a gap 262 disposed therebetween.

Figure 8:
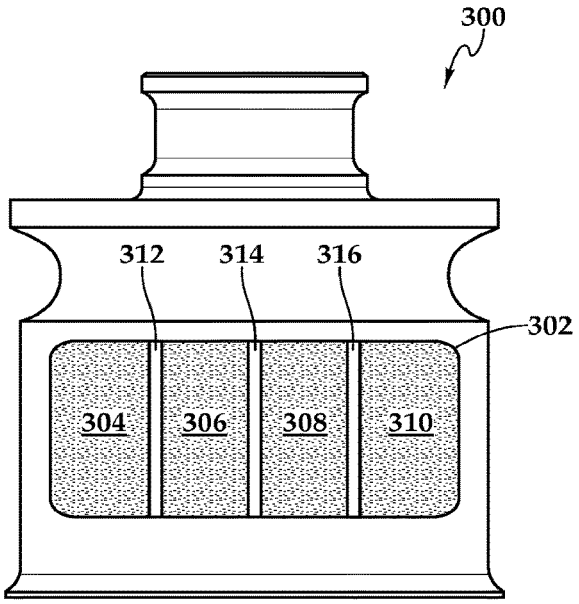
FIG. 8 is side view of a journal bearing including independent hardmetal weld pads according to an embodiment of the present disclosure.

Even though FIGS. 3-7 have depicted and described journal bearings having circumferentially extending gaps between adjacent hardmetal weld pads, it should be understood by those skilled in the art that journal bearings having gaps between adjacent hardmetal weld pads with other configurations are possible and are considered to be within the scope of the present disclosure. For example, as best seen in FIG. 8, a journal bearing 300 includes a radially reduced pocket 302 positioned on the load side of journal bearing 300. In the illustrated embodiment, radially reduced pocket 302 extends circumferentially about the load side of journal bearing 300 for approximately 120 degrees. Four independent hardmetal weld pads 304, 306, 308, 310 are positioned in radially reduced pocket 302 of journal bearing 300. Hardmetal weld pads 304, 306, 308, 310 may be applied to radially reduced pocket 302 in a manner described above or other suitable manner. In the illustrated embodiment, hardmetal weld pads 304, 306 have a vertical gap 312 disposed therebetween, hardmetal weld pads 306, 308 have a vertical gap 314 disposed therebetween and hardmetal weld pads 308, 310 have a vertical gap 316 disposed therebetween.

Figure 9:
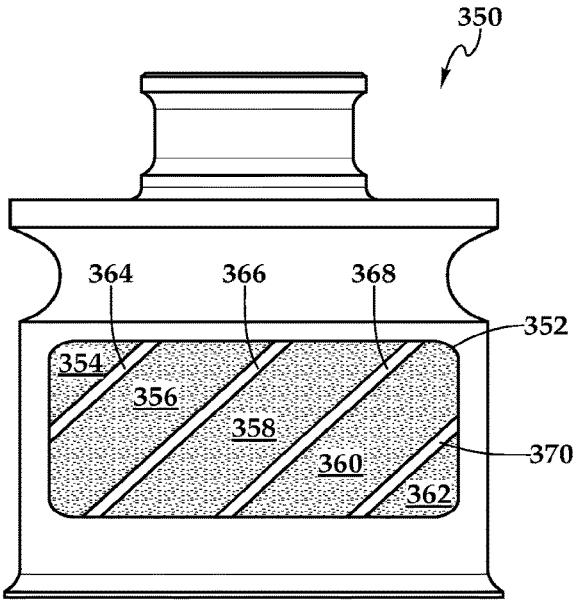
FIG. 9 is side view of a journal bearing including independent hardmetal weld pads according to an embodiment of the present disclosure.

As another example, as best seen in FIG. 9, a journal bearing 350 includes a radially reduced pocket 352 positioned on the load side of journal bearing 350. In the illustrated embodiment, radially reduced pocket 352 extends circumferentially about the load side of journal bearing 350 for approximately 120 degrees. Five independent hardmetal weld pads 354, 356, 358, 360, 362 are positioned in radially reduced pocket 352 of journal bearing 350. Hardmetal weld pads 354, 356, 358, 360, 362 may be applied to radially reduced pocket 352 in a manner described above or other suitable manner. In the illustrated embodiment, hardmetal weld pads 354, 356 have a diagonal gap 364 disposed therebetween, hardmetal weld pads 356, 358 have a diagonal gap 366 disposed therebetween, hardmetal weld pads 358, 360 have a diagonal gap 368 disposed therebetween and hardmetal weld pads 360, 362 have a diagonal gap 370 disposed therebetween.

Figure 10:
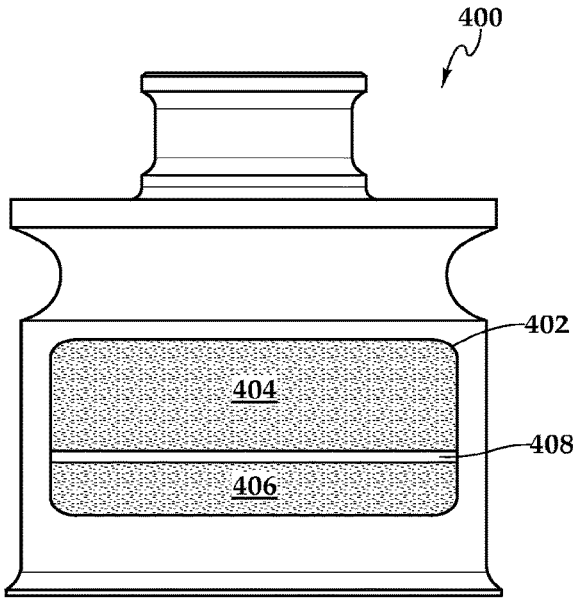
FIG. 10 is side view of a journal bearing including independent hardmetal weld pads according to an embodiment of the present disclosure.

Even though FIGS. 3-8 have depicted and described journal bearings having independent hardmetal weld pads of a uniform size, it should be understood by those skilled in the art that journal bearings having independent hardmetal weld pads of different sizes are possible and are considered to be within the scope of the present disclosure. For example, as best seen in FIG. 10, a journal bearing 400 includes a radially reduced pocket 402 positioned on the load side of journal bearing 400. In the illustrated embodiment, radially reduced pocket 402 extends circumferentially about the load side of journal bearing 400 for approximately 120 degrees. Two independent hardmetal weld pads 404, 406 are positioned in radially reduced pocket 402 of journal bearing 400. Hardmetal weld pads 404, 406 may be applied to radially reduced pocket 402 in a manner described above or other suitable manner. In the illustrated embodiment, hardmetal weld pads 404, 406 have a gap 408 disposed therebetween. As illustrated, hardmetal weld pad 404 is larger than hardmetal weld pad 406.

Figure 11:
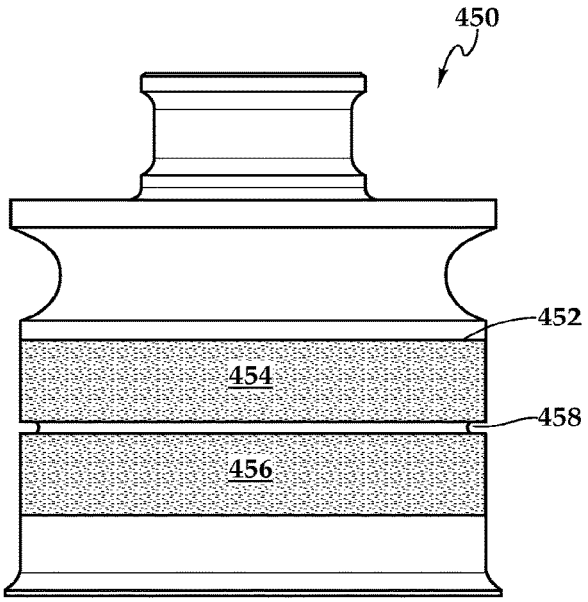
FIG. 11 is side view of a journal bearing including independent hardmetal weld pads according to an embodiment of the present disclosure.

Even though FIGS. 3-10 have depicted and described journal bearings having radially reduced pockets having a particular circumferential length, it should be understood by those skilled in the art that journal bearings having radially reduced pockets having other circumferential lengths both greater and less than 120 degrees are possible and are considered to be within the scope of the present disclosure. For example, as best seen in FIG. 11, a journal bearing 450 includes a radially reduced region 452 extending 360 degrees around the circumference of journal bearing 450. Two independent hardmetal weld pads 454, 456 are positioned in radially reduced region 452 of journal bearing 450. Hardmetal weld pads 454, 456 may be applied to radially reduced region 452 in a manner described above or other suitable manner. In the illustrated embodiment, hardmetal weld pads 454, 456 have a gap 458 disposed therebetween that extends 360 degrees around the circumference of journal bearing 450.

Figure 12:
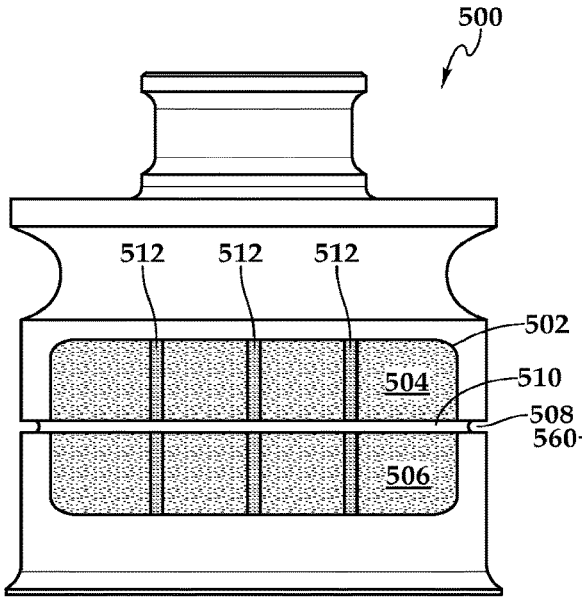
FIG. 12 is side view of a journal bearing including independent hardmetal weld pads according to an embodiment of the present disclosure.

Referring to FIG. 12, a journal bearing 500 includes a radially reduced pocket 502 positioned on the load side of journal bearing 500. In the illustrated embodiment, radially reduced pocket 502 extends circumferentially about the load side of journal bearing 500 for approximately 120 degrees. Two independent hardmetal weld pads 504, 506 are positioned in radially reduced pocket 502 of journal bearing 500. Hardmetal weld pads 504, 506 may be applied to radially reduced pocket 502 in a manner described above or other suitable manner. In the illustrated embodiment, hardmetal weld pads 504, 506 have a gap 508 disposed therebetween. In the illustrated embodiment, once hardmetal weld pads 504, 506 have been applied to radially reduced pocket 502, a radially reduced groove 510 may be machined into journal bearing 500 that extends circumferentially beyond radially reduced pocket 502 and in this case, 360 degrees around journal bearing 500 such that radially reduced groove 510 intersects a lubricant reservoir, thereby becoming a lubricant passage to aid in distribution of lubricant to the contact surfaces of hardmetal weld pads 504, 506. To further aid in distribution of lubricant to the contact surfaces of hardmetal weld pads 504, 506, a lubricant distribution network 512 has been machined into the surface of hardmetal weld pads 504, 506. As illustrated, lubricant distribution network 512 is formed by a plurality of channels that extend axially from radially reduced groove 510 but extend radially through only a portion of the thickness of hardmetal weld pads 504, 506. Those skilled in the art with understand that lubricant distribution networks having other configurations and radial depth are possible and are considered to be within the scope of the present disclosure.

Figure 13:
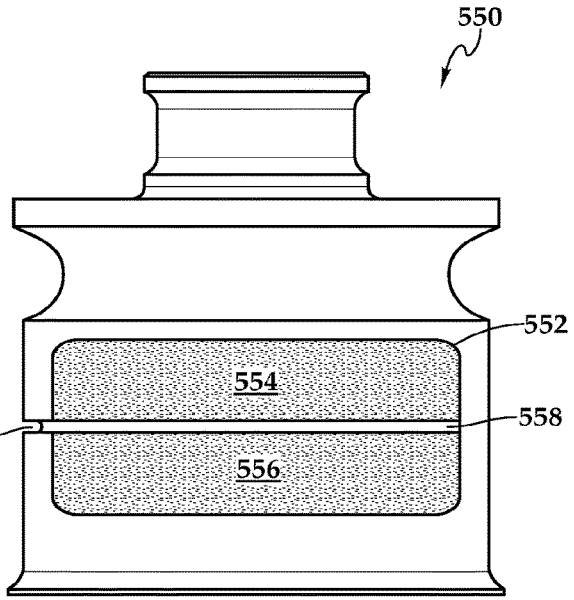
FIG. 13 is side view of a journal bearing including independent hardmetal weld pads according to an embodiment of the present disclosure.

Even though FIGS. 5 and 12 have depicted and described journal bearings having radially reduced grooves that intersect a lubricant reservoir having a particular circumferential length, it should be understood by those skilled in the art that journal bearings having radially reduced grooves that intersect a lubricant reservoir having other circumferential lengths are possible and are considered to be within the scope of the present disclosure. For example, as best seen in FIG. 13, a journal bearing 550 includes a radially reduced pocket 552 positioned on the load side of journal bearing 550. In the illustrated embodiment, radially reduced pocket 552 extends circumferentially about the load side of journal bearing 550 for approximately 120 degrees. Two independent hardmetal weld pads 554, 556 are positioned in radially reduced pocket 552 of journal bearing 550. Hardmetal weld pads 554, 556 may be applied to radially reduced pocket 552 in a manner described above or other suitable manner. In the illustrated embodiment, hardmetal weld pads 554, 556 have a gap 558 disposed therebetween. A radially reduced groove 560 may be machined into journal bearing 550 that extends circumferentially from a single edge of radially reduced pocket 552 to a lubricant reservoir (not visible), thereby providing a lubricant passage to aid in distribution of lubricant to the contact surfaces of hardmetal weld pads 554, 556.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A drill bit comprising:

a drill bit body for coupling to a lower end of a drill string, the drill bit body including at least one support arm having an inwardly extending journal defining an axis of rotation, the journal including a journal bearing having at least one radially reduced pocket extending from an outer surface of the journal bearing into a base metal of the journal bearing and circumferentially around at least a portion of a load side of the journal bearing;

at least one rotary cutter assembly rotatably mounted to the journal about the axis of rotation;

a plurality of cutting elements disposed on the at least one rotary cutter assembly; and at least two independent hardmetal weld pads, each of the hardmetal weld pads sharing the same outer diameter along an outer surface of the journal bearing, and deposited within the at least one radially reduced pocket and fused with the base metal therein, the hardmetal weld pads having a circumferential gap disposed therebetween such that the hardmetal weld pads are separated from one another in a direction along the axis of rotation.

2. The drill bit as recited in claim 1 wherein the base metal extends between the hardmental weld pads within the circumferential gap.

3. The drill bit as recited in claim 2 wherein an interior surface of the rotary cutter assembly further comprises a circumferentially extending groove positioned adjacent to the base metal gap to prevent contact between the base metal gap and the interior surface of the rotary cutter assembly.

4. The drill bit as recited in claim 1 wherein the circumferential gap further comprises a radially reduced groove disposed between the hardmetal weld pads, the radially reduced groove defining a reduced outer diameter with respect to the outer diameter shared by the hardmetal weld pads.

5. The drill bit as recited in claim 4 wherein the load side is defined on a lower side of the journal bearing when the drill bit body is coupled to the lower end of the drill string, wherein the radially reduced pocket extends circumferentially only about 120 degrees only on the load side of the journal bearing, and wherein the circumferentially extending radially reduced groove extends circumferentially beyond the radially reduced pocket.

6. The drill bit as recited in claim 4 wherein the journal bearing further comprises a grease reservoir and wherein the radially reduced groove is in fluid communication with the grease reservoir.

7. The drill bit as recited in claim 1 wherein the at least one radially reduced pocket and the hardmetal weld pads extend circumferentially 360 degrees around the journal bearing.

8. The drill bit as recited in claim 1 further comprising at least three independent hardmetal weld pads positioned within the at least one radially reduced pocket.

9. A drill bit comprising:

a drill bit body for coupling to a lower end of a drill string, the drill bit body including at least one support arm having an inwardly extending journal with a journal bearing comprising a base metal portion extending to an outer diameter of the journal bearing to define an outer surface of the journal bearing, the journal bearing having a grease reservoir and at least one radially reduced pocket extending radially into the base metal portion and at least partially circumferentially around a load side of the journal bearing;

at least one rotary cutter assembly rotatably mounted to the journal such that the rotary cutter assembly rotatively contacts the load side of the journal bearing;

a plurality of cutting elements disposed on the at least one rotary cutter assembly; and at least two independent hardmetal weld pads, each of the hardmetal weld pads extending to the same outer diameter as the base metal portion, and deposited within the at least one radially reduced pocket and fused to the base metal therein, the hardmetal weld pads having a circumferentially extending radially reduced groove disposed therebetween that is in fluid communication with the grease reservoir.

10. The drill bit as recited in claim 9 wherein the circumferentially extending radially reduced groove extends circumferentially beyond the radially reduced pocket.

11. The drill bit as recited in claim 9 wherein the at least one radially reduced pocket and the hardmetal weld pads extend circumferentially 360 degrees around the journal bearing.

12. The drill bit as recited in claim 9 further comprising at least three independent hardmetal weld pads positioned within the at least one radially reduced pocket.

13. The drill bit as recited in claim 1, wherein the journal bearing defines a ball race extending circumferentially around the axis of rotation, and wherein each of the hardmetal pads are disposed axially between the support arm and the ball race.

* * * * *